United States Patent [19]

Petersen

[11] Patent Number: 4,493,012

[45] Date of Patent: Jan. 8, 1985

[54] COMBINED FIXTURE AND SHADE FOR TUBULAR FLUORESCENT LAMPS

[76] Inventor: Jann Petersen, 34, Rytterbakken, DK-2670 Greve Strand, Denmark

[21] Appl. No.: 414,322

[22] PCT Filed: Dec. 10, 1981

[86] PCT No.: PCT/DK81/00113

§ 371 Date: Aug. 10, 1982

§ 102(e) Date: Aug. 10, 1982

[87] PCT Pub. No.: WO82/02081

PCT Pub. Date: Jun. 24, 1982

[30] Foreign Application Priority Data

Dec. 11, 1980 [DK] Denmark ..... 5277/80

[51] Int. Cl.[3] ..... F21S 3/00

[52] U.S. Cl. ..... 362/225; 362/217; 362/221; 362/247; 362/249; 362/296; 362/341

[58] Field of Search ..... 362/225, 217, 221, 247, 362/249, 296, 341

[56] References Cited

U.S. PATENT DOCUMENTS 3,060,310 10/1962 Bertsche ..... 362/221

4,122,511 10/1978 Petersen ..... 362/354

*Primary Examiner*—Stephen J. Lechert, Jr.

*Attorney, Agent, or Firm*—Ernest F. Marmorek

[57] ABSTRACT

The fixture and shade, build together, for a tubular fluorescent lamp (20) comprises a shade provided with longitudinally extending limitation walls (10, 26) which on their inner-sides in cross sections follow a smooth concave curve. Within the shade transverse shade cross plates (12) are arranged evenly distributed along the length of the shade and fastened to the limitation walls (10, 26). A first and a second transverse shade and plate (18 and 16 respectively) are mounted one at each end of the shade. Said end plates (16 and 18) carries the sockets (48 and 50) necessary to receive the tubular lamp and defining between them the lamp axis (55) of the shade. The second end plate (16) is mounted at the one end of the shade limitation walls (10, 26), whereas the first end plate (18) is secured hereto in some distance from the opposite ends of these walls, at which ends the limitation walls are interconnected by a transverse outer wall (22). Within the transformer chamber (34), that is provided between said outer wall (22) and said first end wall (18), as the transformer (36, 38) of the fixture is arranged and it is connected to the socket (48) supported by the adjoining first end plate (18) through a hole in said end plate and to the socket (50) supported by the opposite first end plate (16) by means of conductors, preferably in the form of a two-conductor cable (32) arranged and guided within the shade. The first end plate (18) is provided with a lamp lead-in opening (56) placed excentrically relative to the shade lamp axis (55) and outside the circumference of the socket (50) mounted on this first end plate (16). Through said lead-in opening (56) a tubular lamp can be inserted in the shade by a longitudinal displacement, made possibly by each shade cross plate (12) being provided with such an elongated opening (60) that the tubular lamp (20) with its whole length can be inserted in the shirm by a longitudinal displacement parallel to the shade lamp axis (55) and then rest on the shade cross plates (12) for thereafter through the spaces between the shade cross plates to be gripped by hand, rotated and by a transverse displacement brought into engagement with the sockets (48 and 50). Such a fixture has a maximum height limited to the height of the shade and constitutes herewith a unit that can be arranged in a simple manner adapted to the available space and that ensures a possibility of a simple and safe renewal of the tubular fluorescent lamp (20).

15 Claims, 3 Drawing Figures

COMBINED FIXTURE AND SHADE FOR TUBULAR FLUORESCENT LAMPS

FIELD OF THE INVENTION

This invention relates to a combined fixture and shade for tubular fluorescent lamps and of the type appearing from the generic part of claim 1.

BACKGROUND OF THE INVENTION

As appears for example from British patent specification No. 556,531, in the known devices for the type stated the transformer unit, comprising a.o. a reactor and a glow switching tube, is mounted within an elongated box arranged above the shade or shades, and the tubular fluorescent lamp, in the following called tube lamp, can from above be inserted in the shade or shades and at the ends of this or these be brought to engage the transformer unit sockets, at said ends extending downwards from the transformer box and being electrically connected to the transformer unit. By such fixtures for tube lamps, however, the renewal of the tube lamp is ackward and owing thereto, that the shade often is not easy of access, difficult to carry through.

By other such combined devices, especially such provided at the underside with a grate to prevent dazzling, it is necessary to take the shade more or less apart before renewal of the tube lamp can take place, wherefore, in such cases the renewal of the tube lamp is complicated and often connected to great danger, especially while often it is necessary for the renewal to use a more or less wobbly ladder standing on which the person taking care of the renewal has to manipulate with various shade parts as well as with a new and an old tube lamp.

Fixtures for tube lamps are also known, however, which are independent of the shades, which are adapted to be directly hanged up on the tube lamp when this is mounted between sockets arranged on the underside of a transformer box, conf. for example British patent specification No. 819,549 and U.S. Pat. No. 4,122,511. From the last said specification it is further known that in certain cases tube lamp before being mounted in the sockets of the fixture is led through openings in the end parts of the shade so that the ends of the tube lamp protrude from one each of the shade end parts. Hereby is obtained the advantage, that the shade may be provided with side and top plates having reflecting inner faces surrounding the discharge tube whereby the greatest possible luminous yield from the discharge tube can be obtained.

Shades of the type stated in the generic part of the main claim and per se known from the said U.S. Pat. No. 4,122,511 makes it possible, provided the discharge tube is located in a prescribed distance from the surface illuminated, to obtain an approximately uniform illumination of this surface over its whole illuminated area, and that is of great importance for example in stores and many offices.

Such shades must be given, however, if they have to be effective, a large height compared with the diameter of the tube lamp, i.e. a height of 3 to 4 times this diameter, and since the transformer box has a height at least not minor than the diameter of the discharge tube, the whole combined fixture and shade has a very large total height. By many arrangements of the fixture, especially if it is desired that the plane of symmetri of the shade has to form an angle with vertical, for example to ensure illumination of articles placed in case racks this great height constitutes an essential disadvantage. Further, the transformer box has to be manufactured separately resulting in the production grewing relatively expensive, especially when the combined fixture and shade has to occur in different shapes adapted to different diameters and lengths of the tube lamp.

This disadvantage appears still more distinct in connection with fixtures not combined with a shade but demanding a shade to be mounted on the tube lamp itself since in such cases shade plus fixture takes up still more space. Further in connection with shades suspended in the tube lamp itself quite a number of manipulations with the different parts are necessary when the tube lamp has to be renewed.

OBJECTS OF THE INVENTION

An object of the invention is to provide a fixture of the type stated in the generic part of claim 1 by which the height of the combination can be essential limited, which does not demand especially formed parts such as a longitudinal transformer box, and by which renewal of the tube lamp can be carried out in a slackened easy manner and that without the possibility of obtaining the greatest possible luminous yield is being lost, on the contrary said yield being increased compared with the known combinations of the type stated.

SUMMARY OF THE INVENTION

These objects and others, according to the invention are attained by the means stated in the characterizing clause of claim 1.

When the transformer unit as a whole is mounted in a special transformer chamber constituting a prolongation of the shade wherein the tube lamp is mounted, there is obtained the essential advantage that the total height of the combined fixture and shade only corresponds to the height of the shade itself, and since the conductors connecting the transformer unit with the two sockets of the fixture are conducted within the shade they will not have hampering effects, and will be well protected. This construction is made possible owing to the sockets being fastened to parts of the shade itself, namely to its transverse end plates. This arrangement could, however, make the insertion and renewal of the tube lamp difficult, but such difficulties are prevented by the provision of the inlet opening for the tube lamp in the second end plate excentrically relative to the socket on this end plate and by the special recesses in the shade cross plates. Owing hereto may a tube lamp be for example inserted in the fixture by an axial displacement thereof into the shade until it is fully inserted in the shade, followed by such a transverse displacement, that the contact pins of the tube lamp can be brought to engage the sockets. This insertion is even further facilitated owing thereto that during and after the axial displacement into the shade the tube lamp may rest on the shade cross plates, and that, therefore, then the tube lamp without difficulties can be grasped by the hands, be turned to correct position relative to the sockets, and, after having engaged the latter, again be turned into contact position.

Especial advantageous it is if further the features stated in claim 2 are used, whereby the shade cross plates not only reinforce the casing consisting of the side and top shade plates just as effective as would have been the case by use of a transformer box arranged above the casing, but even ensures the greatest possible luminous yield owing to reflection simultaneously therewith that it grew possible to take the necessary recesses in the shade cross plates as small as possible, especially if also the features of claim 3 are used. Hereby the influences of the recess on the reflection is reduced to a minimum.

Still further the features of claim 4 may be used so that the conductors are retained in a safe manner without use of further aids.

Besides the features of claim 5 may be used so that the limitations of the transformer chamber constitutes a natural elongation of the shade plates. This is not alone an esthetic advantage but also helps in keeping the production cost as small as possible.

Provided further the features of claim 6 are used the transformer chamber will appear as a natural elongation of the shade itself so that in spite of being much more visible than a normal transformer box esthetically it does not appear unpleasant.

Advantageously also the features of claim 7 are used, so that it is prevented that unwanted light radiates from the inlet opening.

Further, if even the features of claim 8 are used without difficulty the fixture may be secured in a certain angular position, for example one of three possibilities, much more effective than by the use of an elongated transformer box by which a securing of a certain angular position of the fixture will demand much more complicated suspension means than is the case, when the same can be connected to the end limitations.

Advantageously still further the features of claim 9 may be used, whereby with consideration to the normally used cross-sectional curvature of the shade side plates it grew possible to obtain a placing of the inlet opening not alone as near as possible to the sockets, but also in the greatest possible distance from the plane of the light radiation opening of the shade and, thereby, the shortest possible length of the recesses in the shade cross plates and the shortest possible transverse displacement of a tube lamp during its insertion in the sockets and, what is of special importance, that the shade cross plates ar unbroken over the greatest possible distance from the light radiation opening of the shade whereby the effect of the reflection from the cross plates may be utilized best possible.

DESCRIPTION OF THE DRAWING

In the following the invention will be described more detailed with reference to the drawing, in which.

DETAILED DESCRIPTION OF A PREFERRED EMBODIMENT

Figure 1:
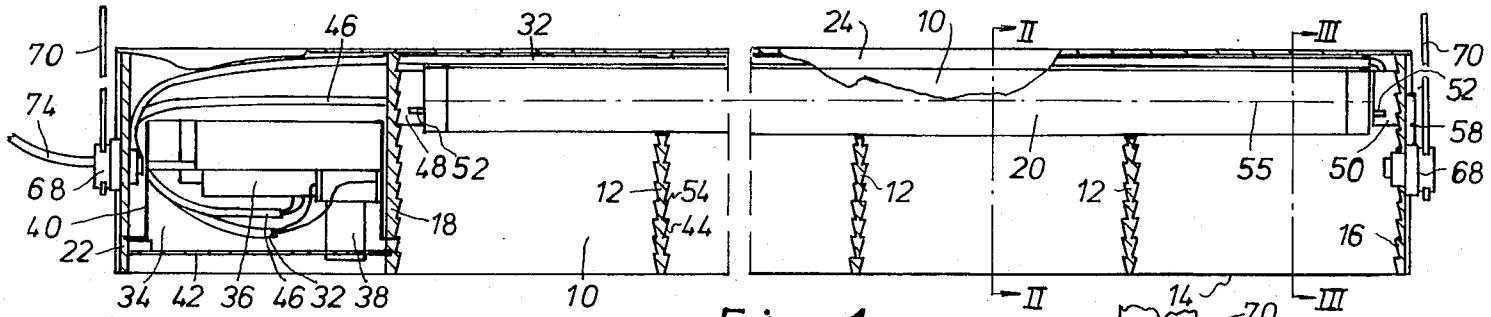
FIG. 1 is a side elevational view of an embodiment of a fixture according to the invention with the one side plate broken away.

The fixture shown comprises a shade having opposite shade side plates 10, the inner smooth surfaces of which are made light reflecting. The shade side plates 10 may for example be made from a relatively hard plastic, such as polystyrene, and their inner faces may be provided with a reflecting metallic surface, for example by plating by evaporation. The shade side plates 10 are mutually interconnected by means of a number, for example seven, although three only are shown, of shade cross plates 12, evenly distributed along the length of the shade and with a mutual distance corresponding to the width of the shade at the downwards facing light radiation opening 14 of the shade, as well as with two shade end plates 16 and 18 of which the end plate 16 is placed at the one end of the fixture shown, whereas the other end plate 18 is placed in a distance from the first said end plate 16 somewhat greater than the length of the tube lamps the fixture is adapted to receive and in a distance approximately equal to the mutual distance between the shade cross plates 12 from the end of the shade side plates opposite to the end plate 16. The shade side plates 12 are at their last said ends interconnected by a transverse outer plate 22.

Both surfaces of the shade cross plates 12 as well as the inner faces of the end plates 16 and 18 are in cross-sections serrated showing downwards facing inclined faces 44 interconnected by nearly horizontal extending cross faces 54. This serration results in the greatest possible downwards directed light reflecting.

The connections between the shade side plates 10 and the transversely extending plates 12, 16, 18 and 22 are obtained by means of screws, even if also welding is possible.

The upper space between the shade side plates 10 is closed by means of a shade top plate 24 that is provided with a downwards extending thick middle portion 26 engaging the space between the side plates 10 and having such a thickness that the inner side of this portion flushes with the inner faces of the side plate 10. The top plate 24 is at each side of its middle portion 26 provided with a side web 28 whereby it can be fastened to the side plates 10 preferably by means of screws screwed into the edges of the transverse plates 12, 16, 18 and 22.

It has to be observed that it will also be possible to make the longitudinal parts of the shade as a unit or as two alike halves, but owing to the method used for metallizing the inner faces of the shade plates such forms will normally be less suitable. Such forms may, however, be advantageous if the shades are made from sheet metal that is on beforehand provided with a reflecting surface on the one side.

Figure 3:
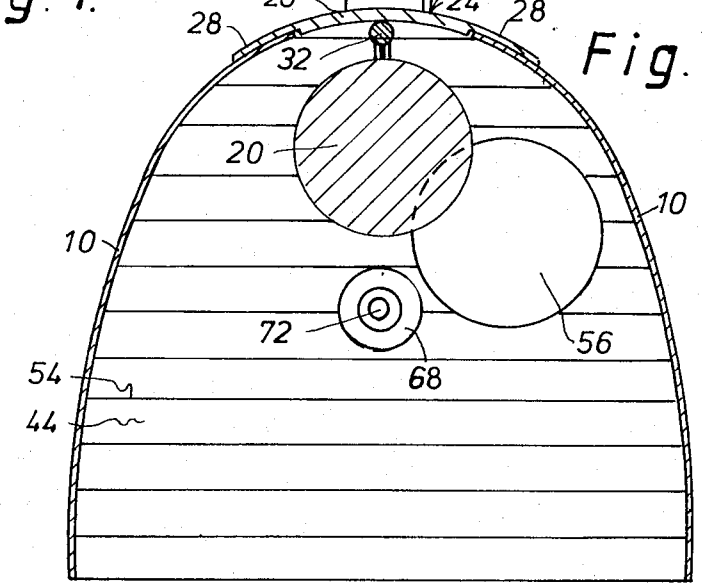
FIG. 3 is a cross sectional view in a larger scale taken along the line III—III in FIG. 1.
Figure 2:
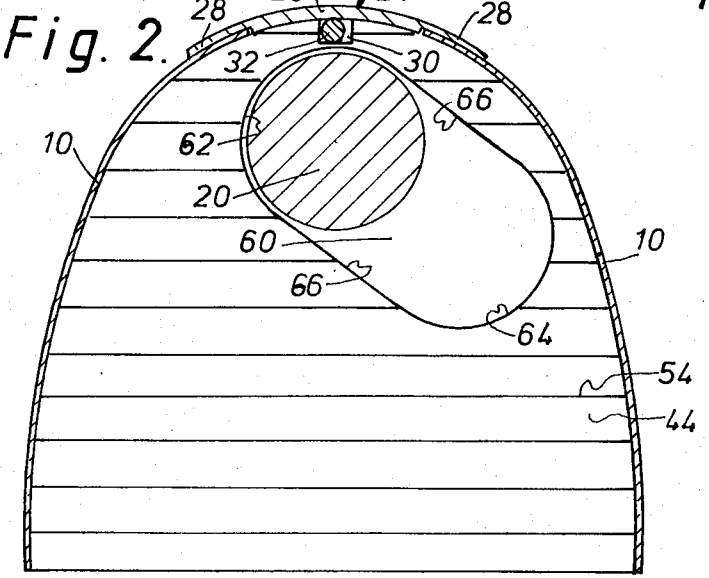
FIG. 2 is a cross sectional view in a larger scale through the fixture shown in FIG. 1, taken along the line II—II in FIG. 1.

As appears from FIGS. 2 and 3 follows the inner faces of the shade in cross sections a smoothly arched curve in a small distance above plane of the light radiation opening 14 is tangent to planes parallel to the plane of symmetry of the shade, and converge below the touching place in some degree against the plane of symmetry. Hereby is obtained the most appropriate form with a view to the obtainancy of an even grade of illumination.

All the transverse plates 14, 16, 18 and 22 has such an outer contour, that each of these plates closely abuts the inner side of the shade, apart therefrom that in each shade cross plates 12 and in the shade end plate 18 the edge of the plate at the top thereof is provided with a notch 30 for receiving and guiding an electric two wire cable 32 more detailed mentioned in the following. Each said transverse plate may also in stead of with the notch be provided with a hole through wich the cable 32 is freely let.

Owing to the firm connection between the side limitation plates 14 and 24 of the shade and the transverse plates 12, 16, 18 and 22, constitutes the shade a stable unit in spite of small thicknesses of the plates being used.

The space 34 between the shade end plate 18 and the outer plate 22 and between the shade limitation plates 10 and 24 serves as a transformer chamber receiving the transformer unit of the fixture shown, which unit comprises among others a reactor 36 and an exchangeable glow switching tube 38. The single parts of the transformer are mounted on a metal frame 40 supported by the outer plate 22 and the end plate 18. The chamber 34 is closed at its lower end by a closing plate 42 provided with an opening through which the lower portion of the glow switching tube 38 extends so that this tube can be exchanged from the outside.

The outer plate 22 is smooth and non-reflecting on both sides.

From the transformer come two two-wire cables, namely a cable 32 and a further cable 46, seing that a conductor of each cable is connected to one each of the two poles of the glow switching tube 38. The cable 32 is through the space above the frame 40 and a hole in the end plate 18 connected to a socket 48 for a discharge tube, which socket is fastened to the end plate 18, whereas the other cable 46 through the notches 30 in the end plate 18 and the shade cross plates 14 is let along the upper part of the shade to a tube lampe socket 50 fastened to the inner side of the end plate 16. The two sockets 48 and 50 are placed on the plates 16 and 18 in such a manner, that their inlet slits 52 for the contact pins of the tube lamp 20 forms an angle of about 35° with the plane of the light radiation opening 14 of the shade.

The two sockets 48 and 50 define the axis 55 of the tube lamp.

In the end plate 16 and close to the outer circumference of the socket 50 there is provided a tube lamp inlet opening 56 having its centre situated in extension of the insertion slit 52 of the socket 50 and closeable by means of a detachable cover or closing cap 58. A tube lamp 20 can through this opening, the diameter of which corresponds with a slight interference to the diameter of the discharge tube, by an axial displacement be inserted in the shade. To ensure that the discharge tube can be totally inserted in the shade is each shade cross plate 12 provided with an elongated tube lamp lead-in opening or recess 60 limited by two semicircular edges 62 and 64, each having the same diameter as the inlet opening 56, and of which the centre of the semi-circular edge 62 is situated in the discharge tube axis 55 whereas the semi-circular edge 58 is co-axial to the opening 58. These two semi-circular edges 62 and 64 are interconnected by tangentially to both semi-circles extending side edges 66.

A tube lamp that through the opening 68 has been axially inserted in the shade will after the insertion be supported by the semi-circular edges of the edge portion 64 of the tube lead-in openings in the shade cross plates 16 where it rest easily accessible from below by hands through the spaces between the cross plates 16 so that easily it can be turned to a position in which its contact pins can be brought to engage the slits 52 and, when totally pushed therinto and rotation of the tube in a normal manner it can be fixed to the sockets 48 and 50.

If a tube lamp 20 has to be removed, the cover 58 is taken off whereafter the tube 20 is rotated relative to the sockets 48 and 50 until its contact pins are situated in the slots 58 whereafter the tube can be withdrawn from the sockets and axially be pushed or drawn out of the shade of the fixture.

Two swivel links 68 are coaxially mounted in one each of the end plate 15 and the outer plate 22, each link being provided outside the corresponding plate with a suspension lever 70 provided close to its free end with a fixing hole so that the fixture can be suspended from or fixed to appropriate suspension or supporting members. Preferably the swivel links 68 are of the type known per se which permit a swing of the suspension lever relative to the fixture either continuously through a certain angle, which demands, however, special fastening means, which may be inexpedient, or between, by spring means fixed angle positions, for example three, namely one, at which the plane of symmetry of the fixture is held vertically, and positions 30° at each side of the middle position, since in practice it has shown up, that said three positions are the most suitable.

Each swivel link 68 is provided with a center opening 72 and through the center opening 72 of the link on the outer plate 22 a feed cable for the transformer and, consequently, for the tube lamp, is led into the transformer chamber 34.

I claim:

1. A combined elongated light fixture and shade structure for at least one fluorescent tube, comprising, in combination, an elongated first housing adapted to hold a tube and open on one side to emit light from a fluorescent tube placed therein, said first housing comprising, two longitudinally extending side plates facing each other, arranged substantially symmetrically on both sides of an imaginary median plane, first and second transversely extending end plates, arranged substantially perpendicularly to said median plane, and attached to said side plates, at least one pair of first and second sockets, adapted to receive a fluorescent tube between said first and second sockets, said first socket mounted on said first end plate, and said second socket mounted on said second end plate, a second housing containing a cavity, adapted to receive a transformer unit, connected to said second end plate, said second housing and said second end plate having openings adapted for the passage therethrough of electrical wiring, means located in said first end plate adapted for the lengthwise insertion therethrough of a fluorescent tube into an initial position inside said first housing, and guiding means adapted to guide the fluorescent tube from said initial into said final position.

2. A combined elongated light fixture and shade structure as claimed in claim 1, wherein said side plates are inwardly reflecting and, in cross-section, smoothly curved.

3. A combined elongated light fixture and shade structure as claimed in claim 2, wherein said first housing further comprises an inwardly reflecting top plate connected to said side plates opposite said one side open to emit light.

4. A combined elongated light fixture and shade structure as claimed in claim 3 wherein said first housing further comprises a plurality of cross plates, substantially parallel to said end plates, evenly distributed in the longitudinal direction of said first housing and connected to said side plates, each said cross plate having an elongated opening, adapted to receive a fluorescent tube in said initial position and to guide movement of the tube to said final position.

5. A combined elongated light fixture and shade structure as claimed in claim 1 wherein the means located in said first end plate, adapted for the lengthwise insertion therethrough of a fluorescent tube into an initial position inside the said first housing, further comprises, an inlet opening for a tube located outside said first socket, said inlet opening being dimensioned to receive a fluorescent tube inserted lengthwise into said first housing.

6. A combined elongated light fixture and shade structure, as claimed in claim 4, wherein each said cross plate conforms to the inner cross-section of said first housing, and wherein said elongated opening in each said cross plate further comprises a first portion, surrounding said final position of the tube, a second portion, surrounding said initial position of the tube, and a connecting passage connecting said first and second portions, wherein the diameters of said first and second portions and the width of said connecting passage are each greater than the diameter of the largest tube adapted to be mounted in the light fixture.

7. A combined elongated light fixture and shade structure, as claimed in claim 6, wherein said first and second portions of said elongated opening are each bounded by a semi-circle of diameter greater than that of the largest tube adapted to be mounted in the light fixture, and said connecting passage is bounded by straight lines tangentially connecting said semi-circles.

8. A combined elongated light fixture and shade structure, as claimed in claim 6, wherein each said cross plate has an aperture, in its edge facing away from said open light-emitting side, adapted to receive and guide electric wiring between said first and second sockets and said transformer unit.

9. A combined elongated light fixture and shade structure as claimed in claim 3, wherein said second housing comprises extensions of said side plates and top plate past said second end plate, and a transverse outer plate connected to said extensions, and wherein said second housing has an opening, on the side corresponding to the light emission opening of the first housing, said opening being fitted with a detachable closing plate.

10. A combined elongated light fixture and shade structure, as claimed in claim 9, wherein the distance between said transverse outer plate and said second end plate is the same as the distance between adjacent said cross plates.

11. A combined elongated light fixture and shade structure, as claimed in claim 5, wherein said inlet opening has a cover, detachable from the outside, which is adapted to be connected to said second end plate, to cover said inlet opening.

12. A combined elongated light fixture and shade structure, as claimed in claim 5, wherein the center of said second socket and the center of said inlet opening are located on an imaginary straight line on said second end plate, which makes an angle greater than 45° with said imaginary median plane.

13. A combined elongated light fixture and shade structure, as claimed in claim 12, wherein said imaginary straight line makes an angle of about 55° with said imaginary median plane.

14. A lighting fixture for a fluorescent tube, comprising, in combination, an elongated housing, including end walls and internal holding means, adapted to receive and to hold inside the housing, in a final lighting position, a fluorescent tube, one of said end walls defining an aperture adapted for the lengthwise insertion therethrough of a fluorescent tube into an initial position inside the housing, and guiding means adapted to guide the fluorescent tube as it is moved from said initial into said final position.

15. A lighting fixture for a fluorescent tube, as claimed in claim 14, further comprising, a second housing, having a cavity adapted to receive a transformer unit, connected to the outside of one of said end walls which does not define the said aperture.

* * * * *